US012569024B1

(12) United States Patent
Davis, Jr.

(10) Patent No.: US 12,569,024 B1
(45) **Date of Patent: *Mar. 10, 2026**

(54) IMPACT PROTECTION SUIT

(71) Applicant: Burnett Davis, Jr., Plano, TX (US)

(72) Inventor: Burnett Davis, Jr., Plano, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/667,458

(22) Filed: May 17, 2024

Related U.S. Application Data

(63) Continuation of application No. 17/385,144, filed on Jul. 26, 2021, now Pat. No. 11,986,040, which is a continuation-in-part of application No. 16/413,406, filed on May 15, 2019, now abandoned.

(60) Provisional application No. 62/671,803, filed on May 15, 2018.

(51) Int. Cl.
*A42B 3/20* (2006.01)
*A41D 13/015* (2006.01)
*A42B 3/04* (2006.01)

(52) U.S. Cl.
CPC ..... *A42B 3/20* (2013.01); *A41D 13/0153* (2013.01); *A42B 3/0453* (2013.01)

(58) Field of Classification Search
CPC ..... Y10T 24/3485; A41D 13/0512
See application file for complete search history.

(56) References Cited

U.S. PATENT DOCUMENTS 3,707,004 A 12/1972 Kapitan
3,878,561 A 4/1975 Winiecki
4,590,622 A 5/1986 Wolfe
4,821,339 A * 4/1989 Fair ..... A42B 3/0473 2/908
4,989,265 A 2/1991 Nipper
4,999,855 A * 3/1991 Brown ..... A63B 71/10 2/909
5,060,313 A 10/1991 Neuhalfen
5,353,437 A 10/1994 Field et al.
5,398,339 A 3/1995 Wagner
5,450,625 A * 9/1995 Hu ..... A63B 71/1225 2/22

(Continued)

FOREIGN PATENT DOCUMENTS

CA 2313872 A1 * 1/2002 ..... A41D 13/0512
CN 204721404 U 10/2015

(Continued)

*Primary Examiner* — Grace Huang
(74) *Attorney, Agent, or Firm* — Law Office of Sam Sokhansanj PLLC

(57) ABSTRACT

A unibody impact protection body suit apparatus that provides air spacing between the head of a user and the interior of the head region of the suit, face and shoulder protection, and situation awareness prior to impact to help prevent various head, neck, shoulder, upper body, and spinal injuries to a user in a contact sport. In particular, the impact protection suit includes a head region having an interior wall region, a shoulder region, and a torso region. Here, the impact protection suit is configured such that the head region provides a vertical and horizontal air spacing between a user's head and the interior wall region that allows the user's head to move within and relative to the housing and further prevents vertical and horizontal contact of the user's head with the interior surface of the housing, thereby minimizing or preventing various, head, neck, and spine injuries.

13 Claims, 17 Drawing Sheets

(56) References Cited

U.S. PATENT DOCUMENTS

| | | | | |
|---|---|---|---|---|
| 5,715,541 | A | 2/1998 | Landau | |
| 5,946,719 | A | 9/1999 | Crupi | |
| 6,047,400 | A | 4/2000 | Spencer | |
| 6,098,196 | A | 8/2000 | Logan | |
| 8,266,727 | B2 | 9/2012 | Lee | |
| 8,281,419 | B2 * | 10/2012 | Rietdyk | A41D 13/0512 602/5 |
| 9,439,469 | B2 | 9/2016 | Phipps | |
| 9,517,401 | B2 * | 12/2016 | Kerr | A63B 71/1291 |
| 10,086,251 | B2 | 10/2018 | Allen | |
| 10,716,352 | B2 | 7/2020 | Knight | |
| 11,452,322 | B2 * | 9/2022 | Elvira | A41D 13/055 |
| 11,986,040 | B1 * | 5/2024 | Davis, Jr. | A42B 3/0473 |
| 12,082,632 | B2 * | 9/2024 | Forsell | A41D 13/0512 |
| 2006/0096010 | A1 * | 5/2006 | Glaser | A42B 3/0473 2/421 |
| 2012/0240317 | A1 | 9/2012 | Diamond | |
| 2013/0055492 | A1 | 3/2013 | Husain | |
| 2013/0247285 | A1 | 9/2013 | Bartsch et al. | |
| 2014/0020157 | A1 | 1/2014 | Barr | |
| 2014/0020161 | A1 | 1/2014 | Mason | |
| 2015/0150313 | A1 | 6/2015 | Huckins | |
| 2016/0150845 | A1 | 6/2016 | Leedom | |
| 2017/0290386 | A1 | 10/2017 | Murray | |
| 2019/0344152 | A1 * | 11/2019 | Popejoy | A63B 71/12 |
| 2020/0329801 | A1 | 10/2020 | Ciccaglione | |

FOREIGN PATENT DOCUMENTS

| | | | | |
|---|---|---|---|---|
| FR | 3020559 | B1 | 7/2016 | |
| GB | 2286763 | A * | 8/1995 | A41D 13/0512 |
| KR | 20110009707 | U * | 10/2011 | A41D 13/0512 |
| WO | WO-9809545 | A1 * | 3/1998 | A41D 13/0055 |
| WO | WO-2017172964 | A1 * | 10/2017 | A41D 13/0512 |

* cited by examiner

IMPACT PROTECTION SUIT

CROSS REFERENCE TO RELATED APPLICATIONS

This application is a continuation of U.S. Non-Provisional application Ser. No. 17/385,144 filed on Jul. 26, 2021, which is incorporated herein by reference in its entirety, which is a continuation-in-part (CIP) of U.S. Non-Provisional application Ser. No. 16/413,406 filed on May 15, 2019, which is incorporated herein by reference in its entirety, which claims the benefit of U.S. Provisional Application No. 62/671,803 filed on May 15, 2018, which is incorporated herein by reference in its entirety.

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

Contact sports, such as football require the use of helmets to help protect participants from injury to their heads due to impact forces that may be sustained during such activities, such as body-to-body or body-to-ground impact. Various types of helmets have been in use in the sport of football. Typically, these helmets have included an outer shell, generally made of an appropriate plastic material, some form of shock absorbing liner within the shell, a face guard, and a chin protector.

There are several drawbacks to the current conventional helmet design. In particular, while the wearer of the helmet is somewhat protected from impact by the spreading of the impact force to the head by the helmet padding, the impact force is still absorbed by the head itself and transferred from the wearer's skull to the brain. In addition, a further problem is the effect of the wearer's helmet impacting an opposing player, wherein the hard-shell design can act as a battering ram against any part of the opposing player's body. This has caused various injuries to the wearer as well as the opposing player, such as concussions, broken bones, and even spinal injury. Further, another problem is that there is no protection from an impact causing the wearer's head to rotate far enough on the spinal column to cause injury to the spine, which could result in paralysis. In addition, whiplash to the neck can result from a quick and violent wrenching of the head in one direction due to, among other things, the player's face mask being grabbed and pulled from the side or the head being forced violently to the front or back, among others. Generally, no protection against spinal injury due to motion of the head beyond these limits is offered by existing helmet designs.

Despite apparent advances in protective equipment like the aforementioned football helmets, and increased awareness of safety issues (i.e., leading to changes in rules of competition), various head, neck, and spine injuries continue to occur at high rates within the sport. Hence, what is needed is head, shoulder, torso, and upper body protective design that provides a secure fit to a user, provides spacing between the head of the user and the interior of the helmet, provides face and shoulder protection, situation awareness prior to impact, among others, to help prevent various head, neck, shoulder, upper body, and spinal injuries to a user in the game of football or other contact sport.

BRIEF SUMMARY

In one aspect of the disclosure described herein, an impact protection body suit apparatus is disclosed that provides a secure fit to a user, provides spacing between the head of the user and the interior of the top head region, provides face and shoulder protection, situation awareness prior to impact, among others, to help prevent various head, neck, shoulder, upper body, and spinal injuries to a user in the game of football or other contact sport. In particular, the impact protection suit includes a head region having an interior wall region, a shoulder region, a torso region. Here, the impact protection suit is configured such that the top head region provides spacing between a user's head and the interior wall region to help minimize or prevent various, head, neck, and spine injuries. In addition, the suit may also include various proximity sensors and audio-visual notification interfaces for alerting the user of impending impact from an opposing player, among other advantages.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

Figure 1:
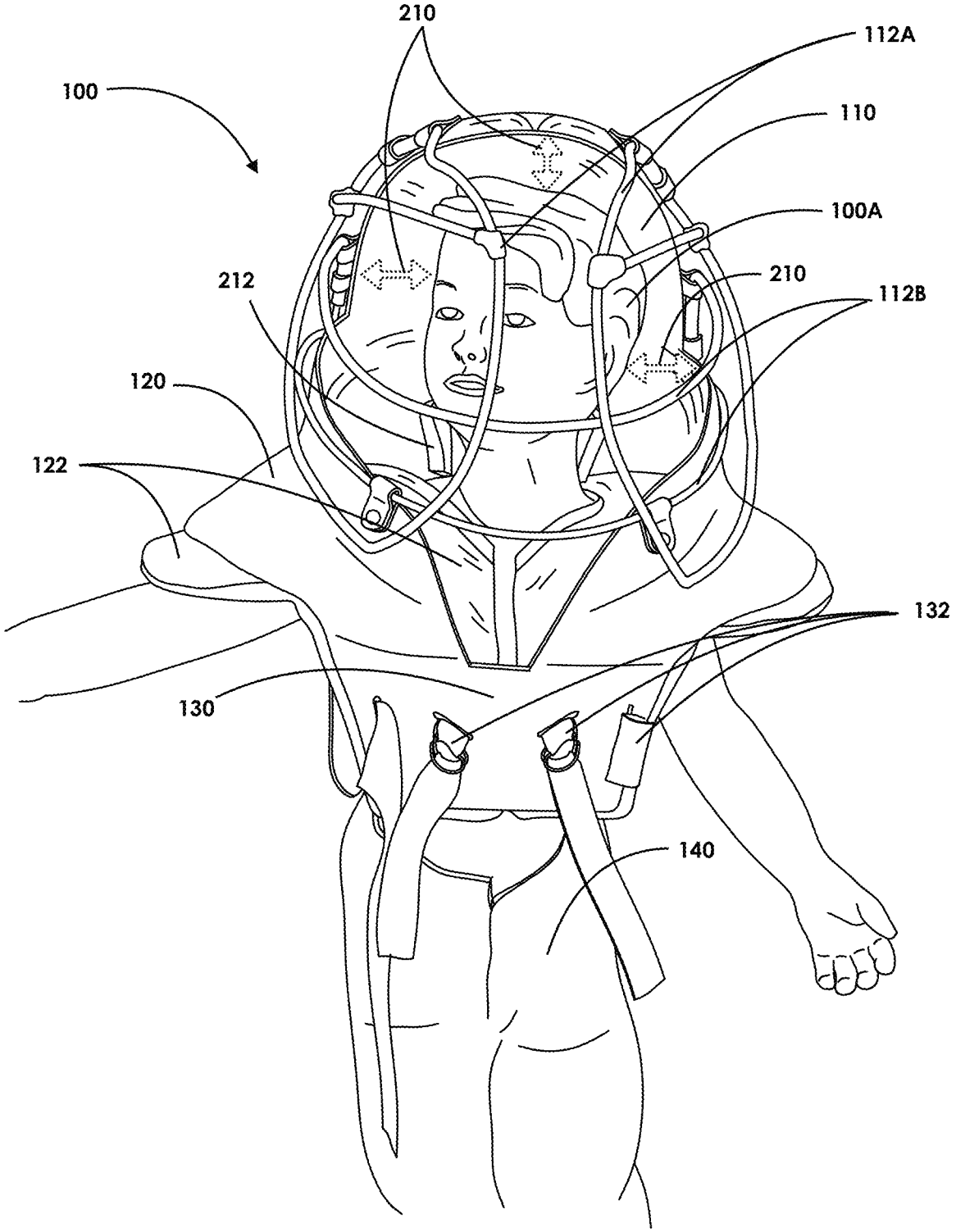
FIG. 1 illustrates a front prospective view for one non-limiting exemplary embodiment of the impact protection suit of the disclosure described herein.

In the Brief Summary of the present disclosure above and in the Detailed Description of the disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

The embodiments set forth below represent the necessary information to enable those skilled in the art to practice the disclosure described herein and illustrate the best mode of practicing the disclosure described herein. In addition, the disclosure described herein does not require that all the advantageous features and all the advantages need to be incorporated into every embodiment of the disclosure described herein.

In one implementation of the disclosure described herein, a display page may include information residing in the computing device's memory, which may be transmitted from the computing device over a network to a central database center and vice versa. The information may be stored in memory at each of the computing device, a data storage resided at the edge of the network, or on the servers at the central database centers. A computing device or mobile device may receive non-transitory computer readable media, which may contain instructions, logic, data, or code that may be stored in persistent or temporary memory of the mobile device, or may somehow affect or initiate action by a mobile device. Similarly, one or more servers may communicate with one or more mobile devices across a network, and may transmit computer files residing in memory. The network, for example, can include the Internet, wireless communication network, or any other network for connecting one or more mobile devices to one or more servers.

Any discussion of a computing or mobile device may also apply to any type of networked device, including but not limited to mobile devices and phones such as cellular phones (e.g., an iPhone®, Android®, Blackberry®, or any "smart phone"), a personal computer, iPad®, server computer, or laptop computer; personal digital assistants (PDAs) such as a Palm-based device or Windows® CE device; a roaming device, such as a network-connected roaming device; a wireless device such as a wireless email device or other device capable of communicating wireless with a computer network; or any other type of network device that may communicate over a network and handle electronic transactions. Any discussion of any mobile device mentioned may also apply to other devices, such as devices including Bluetooth®, near-field communication (NFC), infrared (IR), and Wi-Fi functionality, among others.

Phrases and terms similar to "software", "application", "app", and "firmware" may include any non-transitory computer readable medium storing thereon a program, which when executed by a computer, causes the computer to perform a method, function, or control operation.

Phrases and terms similar "network" may include one or more data links that enable the transport of electronic data between computer systems and/or modules. When information is transferred or provided over a network or another communications connection (either hardwired, wireless, or a combination of hardwired or wireless) to a computer, the computer uses that connection as a computer-readable medium. Thus, by way of example, and not limitation, computer-readable media can also comprise a network or data links which can be used to carry or store desired program code means in the form of computer-executable instructions or data structures and which can be accessed by a general purpose or special purpose computer.

Figure 2:
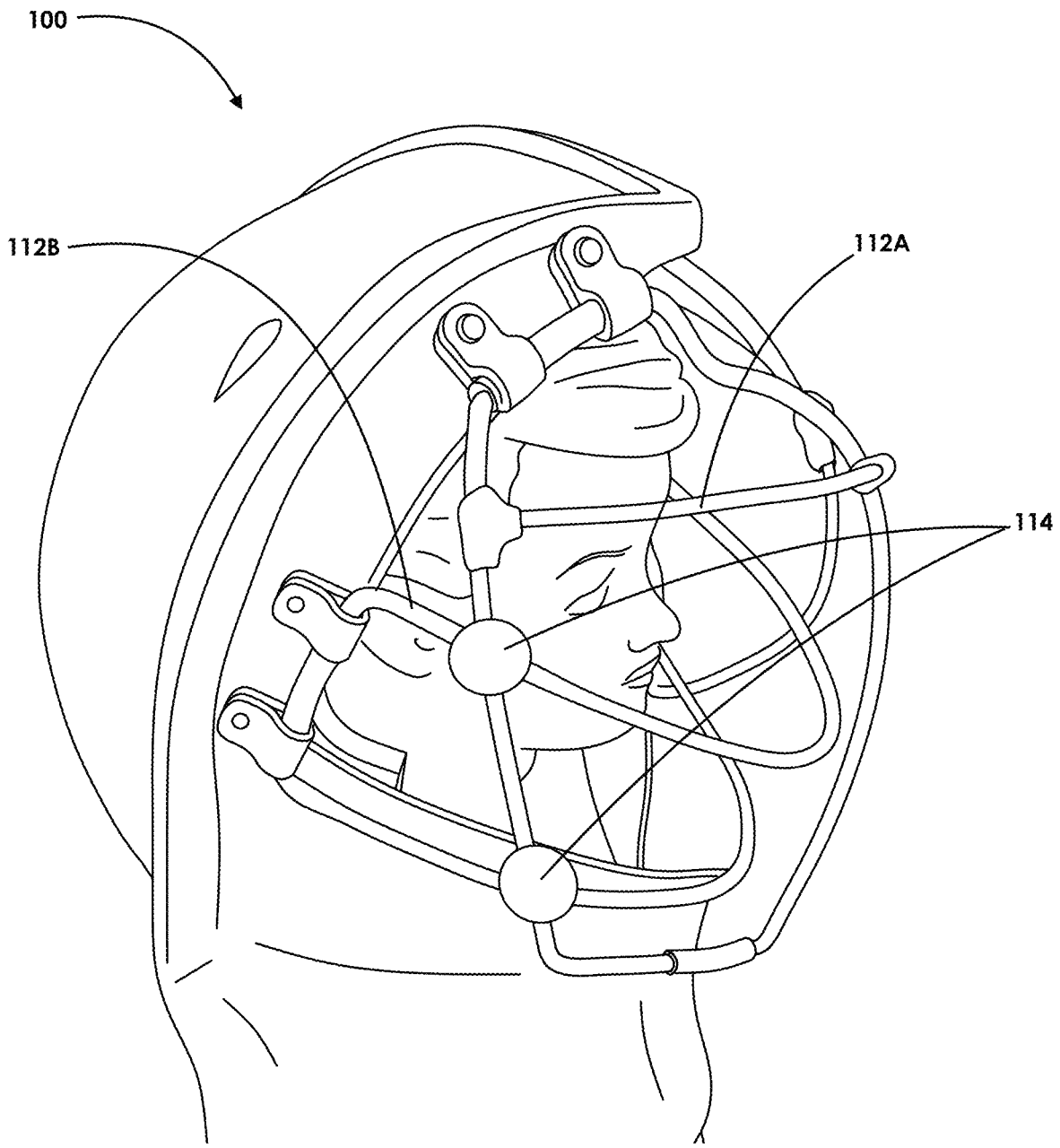
FIG. 2 illustrates a perspective side view of the impact protection suit according of FIG. 1.
Figure 8:
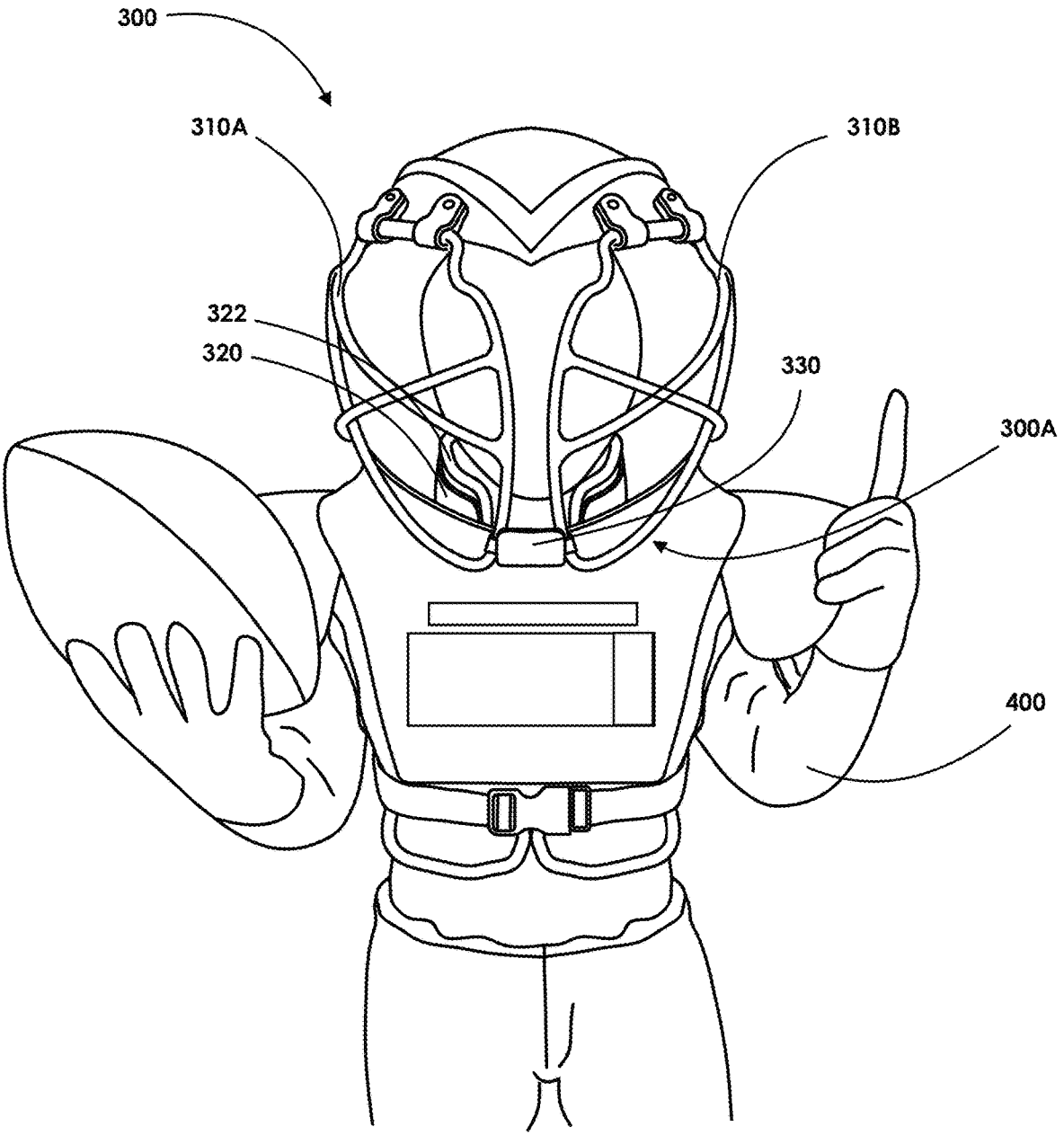
FIG. 8 illustrates a front view for another non-limiting exemplary embodiment of an impact protection suit of the disclosure described herein.
Figure 9:
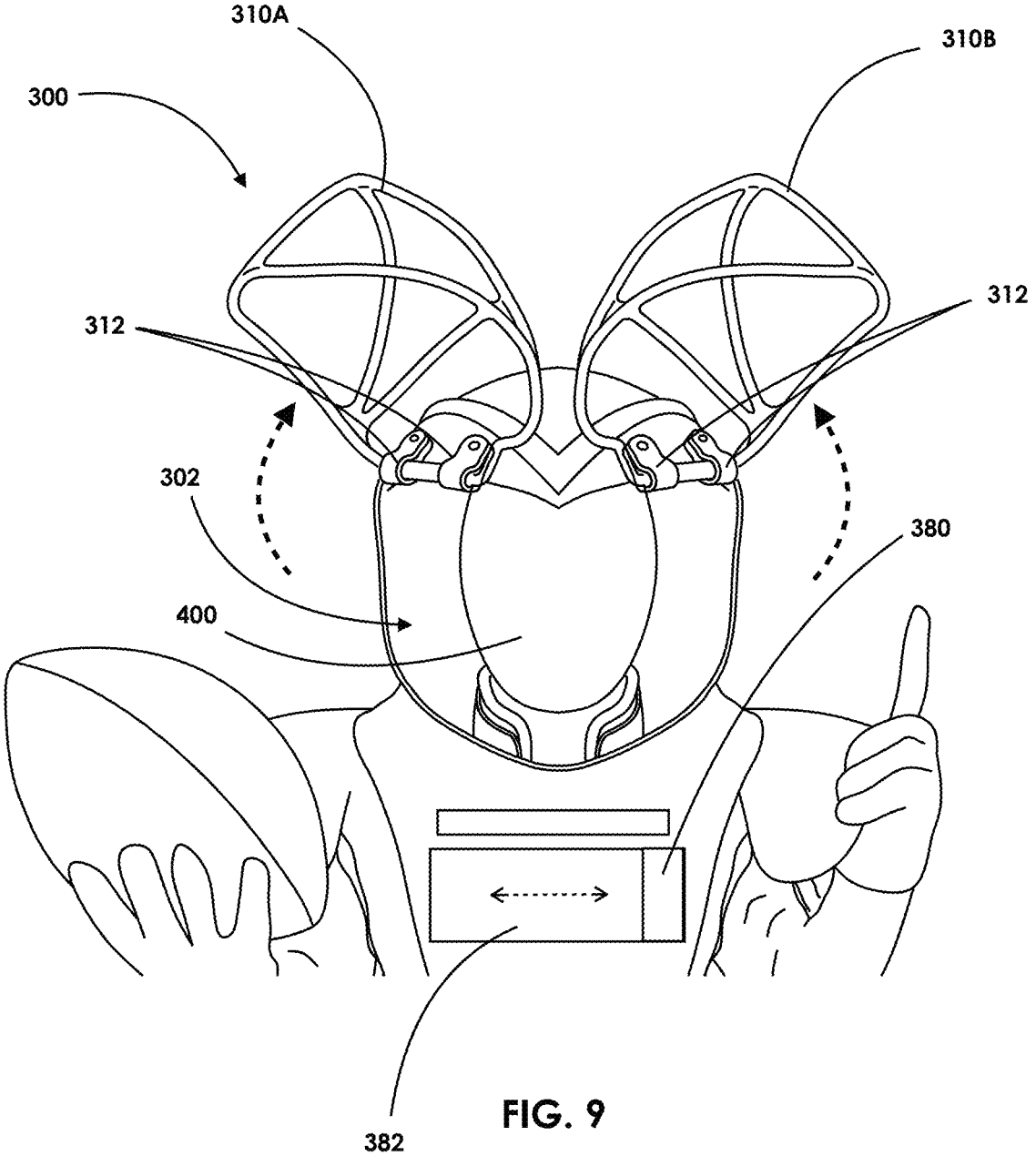
FIG. 9 illustrates a partial front view of the impact protection suit of FIG. 8 illustrating articulating face guards.
Figure 10:
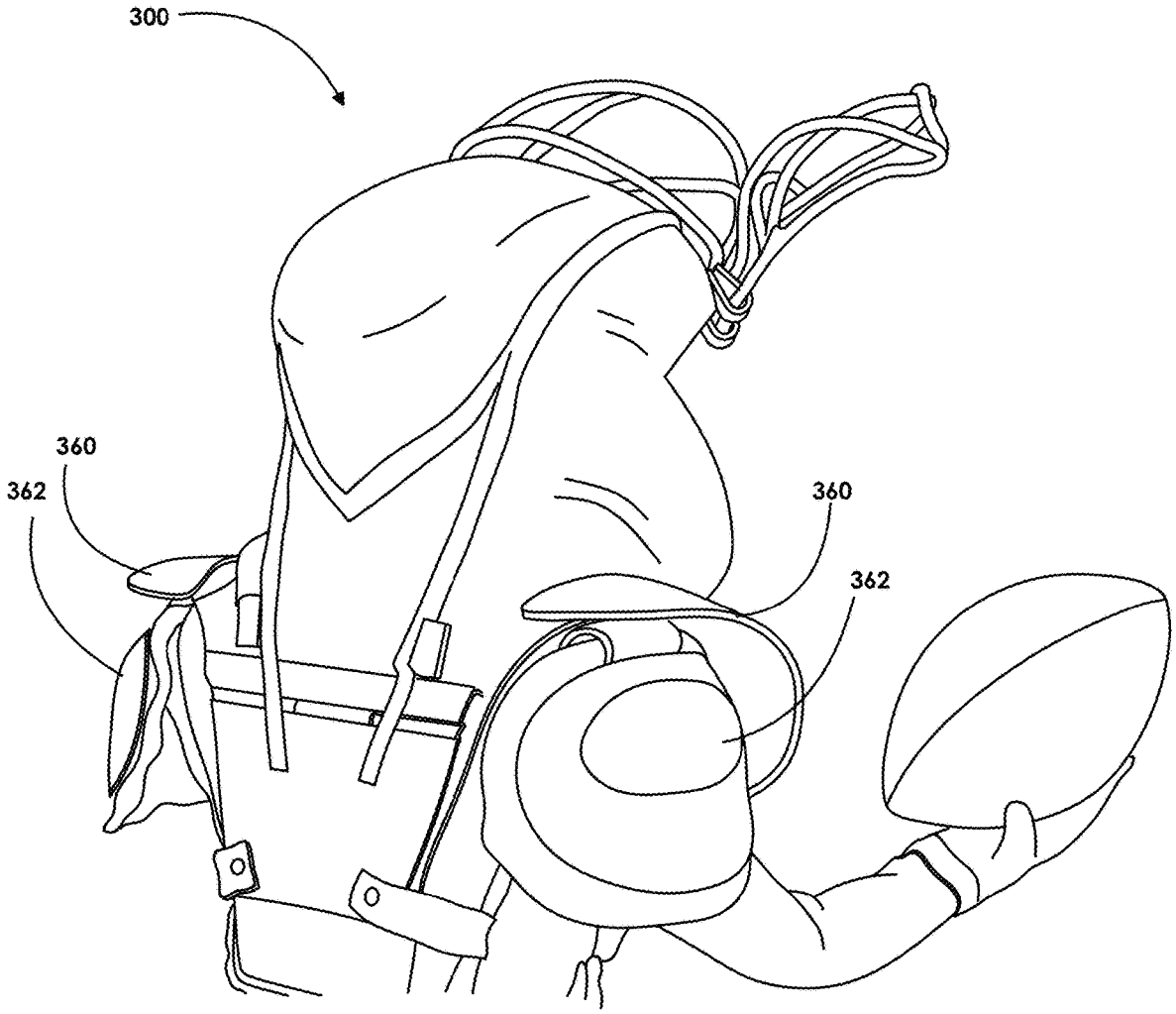
FIG. 10 illustrates a perspective rear view of the impact protection suit of FIG. 8.

FIGS. 1-7B illustrate one non-limiting embodiment of the impact protection suit of the disclosure described herein. FIGS. 8-10 illustrate another non-limiting exemplary embodiment of the impact protection suit of the disclosure described herein. Referring to FIGS. 1-2, suit 100 is shown worn on a user 100A, which includes a top head region 110 for covering and protecting the user's head/neck from impact, a shoulder region 120 for covering and protecting the user's shoulder and upper torso region from impact, and a torso region 130 that guards and covers both the front and back region of the user's torso from impact, such as the chest, ribs, abdomen region, and the upper and lower back. In addition, suit 100 can also be tethered and securely tied to the user's football pants 140 via one or more straps 132, which will be later described in more detail. Here, it is contemplated within the scope of the disclosure described herein that the outer shell of the suit 100 and 300 can be made of any suitable lightweight material that can withstand the impact sustained in football or any contact support, wherein the material can include any type of metal, polymer, plastic, ABS plastic, or woven material, such as aluminum, polyurethane, fiber glass, or the like. Further, the outer shell of suit 100 and 300 may also have any thickness, and may also be pliable, flexible, semi-flexible, or semi-rigid, or have rigid properties, depending on the application and use. For example, the material of suit 100 and 300 can be pliable and flexible such that upon impact it can partially deflect inward and outward (i.e. retain back or pop back to its original configuration) without breakage, cracking, or damage to the shell.

Still referring to FIGS. 1-2, the top region 120 of suit 100 can include a pair of bilateral symmetrical face guards or face cages 112A that can easily articulate or pivot about any point and be moved away to expose or provide quick access to the user's face without the assistance of tools. In addition, lower face guards 112B may articulate or be removed if desired. Further, suit 100 also includes padding 122 that extends within its interior region, such as from the shoulder region and through the torso region of the user. Here, padding 122 may be any type of foam padding that can minimize/dampen impact, or may also be any type of air or liquid inflatable bladder type of cushioning. Moreover, various sections of padding 122 may also be compartmentalized into separate sections, each section having a different level of cushioning, such as the shoulder region having more cushioning and the abdominal region having less or harder cushioning, among other variations.

FIGS. 1-2 further illustrates suit 100 shown having ample spacing or gap 210 between the user's head and neck region and the interior walls of the head region of the suit. Specifically, suits 100 and 300 are optimized to allow for certain movement (or minimized movement) of the user's head at the moment of impact within the interior region of the head region of the suit but without coming into direct contact with the interior top, side, back walls and front mask of the head region of the suit. More specifically, the air spacing or gaps 210 allow the user's head to naturally move if needed but prevents the head from coming into direct contact with the interior walls of the head region of the suit at the moment of impact, unlike conventional football helmets, which help to prevent, minimized, or eliminate head, brain, neck, or spinal injuries. Here, spacing 210 may be anywhere from one-inch up to six-inches or more. In addition, suit 100 further include a neck collar or neck guard 212 to help further prevent the user's head and neck from excessive sudden movement upon impact, such as whiplash, thereby keeping the user's neck and spine in a more natural alignment.

FIG. 2 further illustrates a partial side view of the suit 100. Here, suit 100 can include various types of locks or securement members 114 for securing and/or locking the articulating top face guard 112A with the lower face guard 112B. For example, such securement members can include snaps, tabs, closed loop locks, screw locks, or any other securing device that can also allow for quick release from the outer region of the suit.

Figure 3:
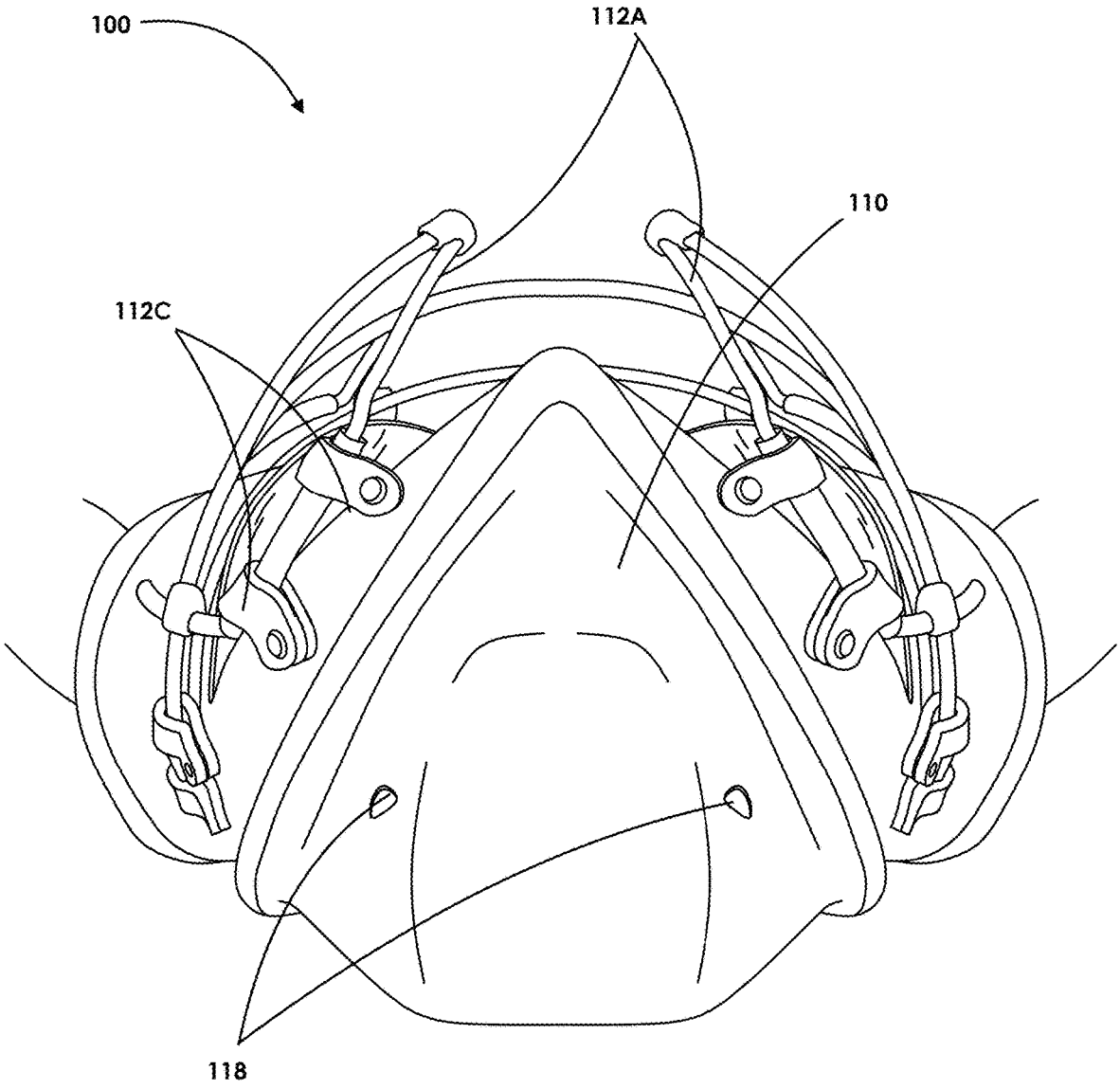
FIG. 3 illustrates a top view of the impact protection suit of FIG. 1.

FIG. 3 illustrates a top view of the suit 100. Here, suit 100 is shown with hinges or pivot points 112C on each side thereof, which can assist the upper front cages or face masks to be moved. In addition, suit 100 is shown having a pair of air holes 118 to allow for the flow of air there-through, which can also be two or more air holes. Alternatively, or in addition to, holes 118 can also be configured to allow any type of fluid, such as water, to be sprayed therethrough to the interior region of the suit 100, thereby allowing the user to cool off within the suit 100 without having to remove it. Furthermore, suits 100 and 300 may also include an integrated fluid or water reservoir and/or one or more pumps connected to various tubes and nozzles within the suit or head region that can spray the fluid within the head region of the user to cool off or provide various liquids and fluids to the user for drinking and hydration purposes. Still referring to FIG. 3, the top head region of the suit may be configured in an A-shape to further help with aerodynamics, wind deflection, and the users' upward and lateral vision capabilities.

Figure 4:
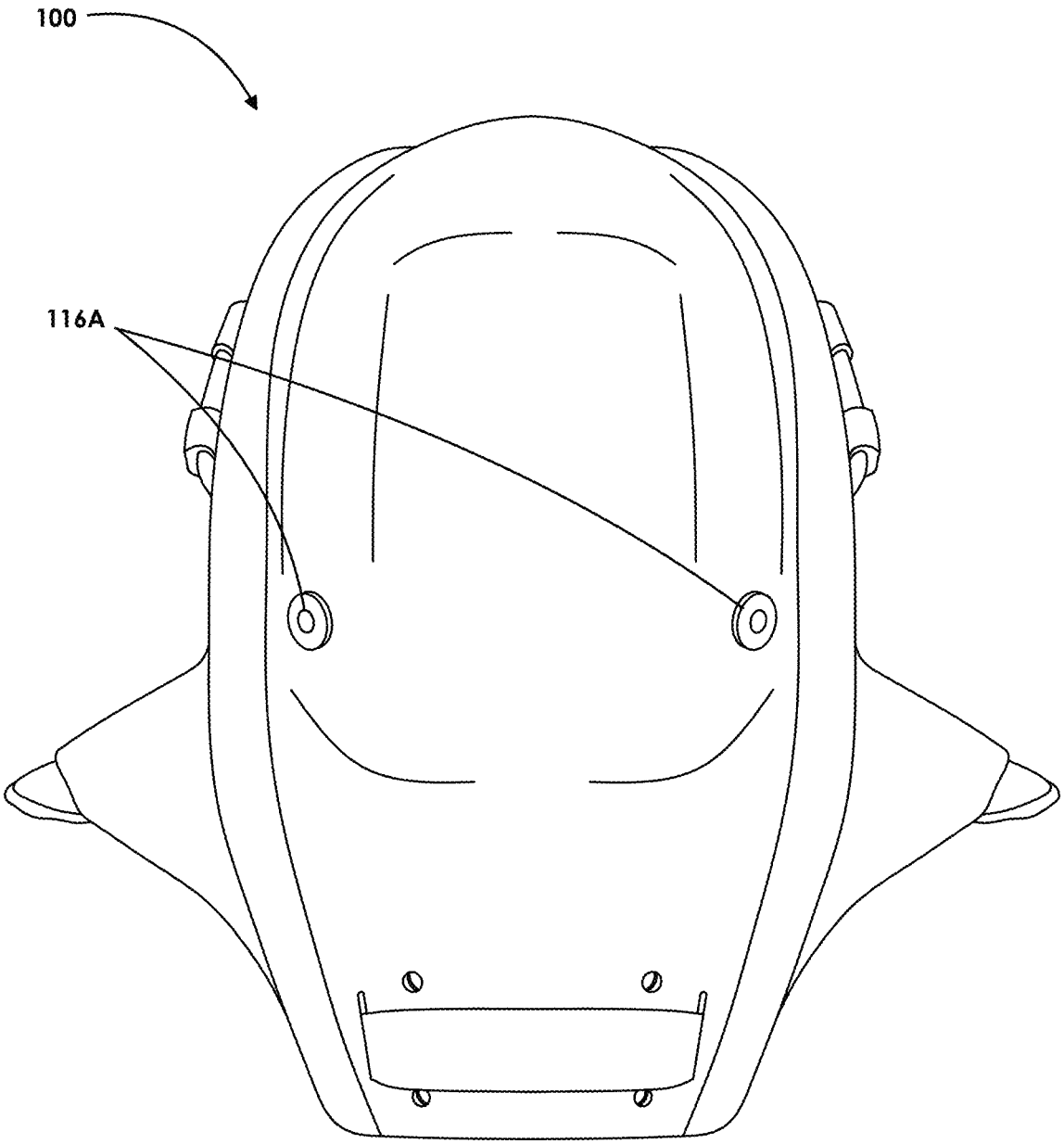
FIG. 4 illustrates a rear view of the impact protection suit of FIG. 1.

FIG. 4 illustrates a rear view of suit 100. More specifically, suit 100 may include various proximity detectors, cameras, or sensors 116A that can detect nearby surrounds such as on-coming or potential impact from an opposing player, and also have video and audio recording capabilities. In addition to or in lieu of sensors 116A, suit 100 can be configured to be integrated with an existing mobile device with an application or software having such camera and recording capabilities. In particular, sensors 116A may also communicate with a computing device or network system that can communicate with and signal to one or more visual and audio signal interface 116B. For example, interface 116B may be a display or any type of alert or notification system, that can alert the user that one or more opposing players are behind, near, around, or in proximity to the user and may pose a potential impact. For example, sensors 116A may be programmed with certain software to sense one or more opposing players (or objects or human bodies) up to a 25-foot radius. In addition, a user may custom configure the range of the sensors, such as only alerting the user when an opposing player is within 10 feet of the user, among other configurations. In addition, each team can have their own set of suits 100, wherein one team has a certain chip or RFID component integrated into the head region of the suit that can only be detected by the opposing team, and not the user's same team (i.e. to help prevent false alarms of the user's same teammates within the user's proximity who may not cause an intentional impact/hit/tackle).

In addition, the user may also custom configure the azimuth, arc, or square foot coverage of the proximity to be detected, such as a 45-degree area behind the user or 360-degrees around the user. In addition, sensors 116A may also provide tracking abilities of the user's movement and logging such data, or keeping count of the number and/or severity of impacts/hits that the user received during a game. For example, the sensors may also include gyro-meters or accelerometers, or any other environmental/stress/velocity/acceleration detection component, that can assist to ascertain the number and/or severity of impact. Here, such data may be automatically uploaded from suit 100 via a network to a central server or downloaded to a user's mobile device to be viewed within an application on the user's mobile computing device. In another embodiment, sensors 116B can allow the user or player to see a red flashing light above their right if the approaching pressure or impact is coming from the player's rear right side. Alternatively, when the approaching pressure or impact is coming from the user or player's rear left side, the player will see a blue flashing light above their left eye.

Figure 5:
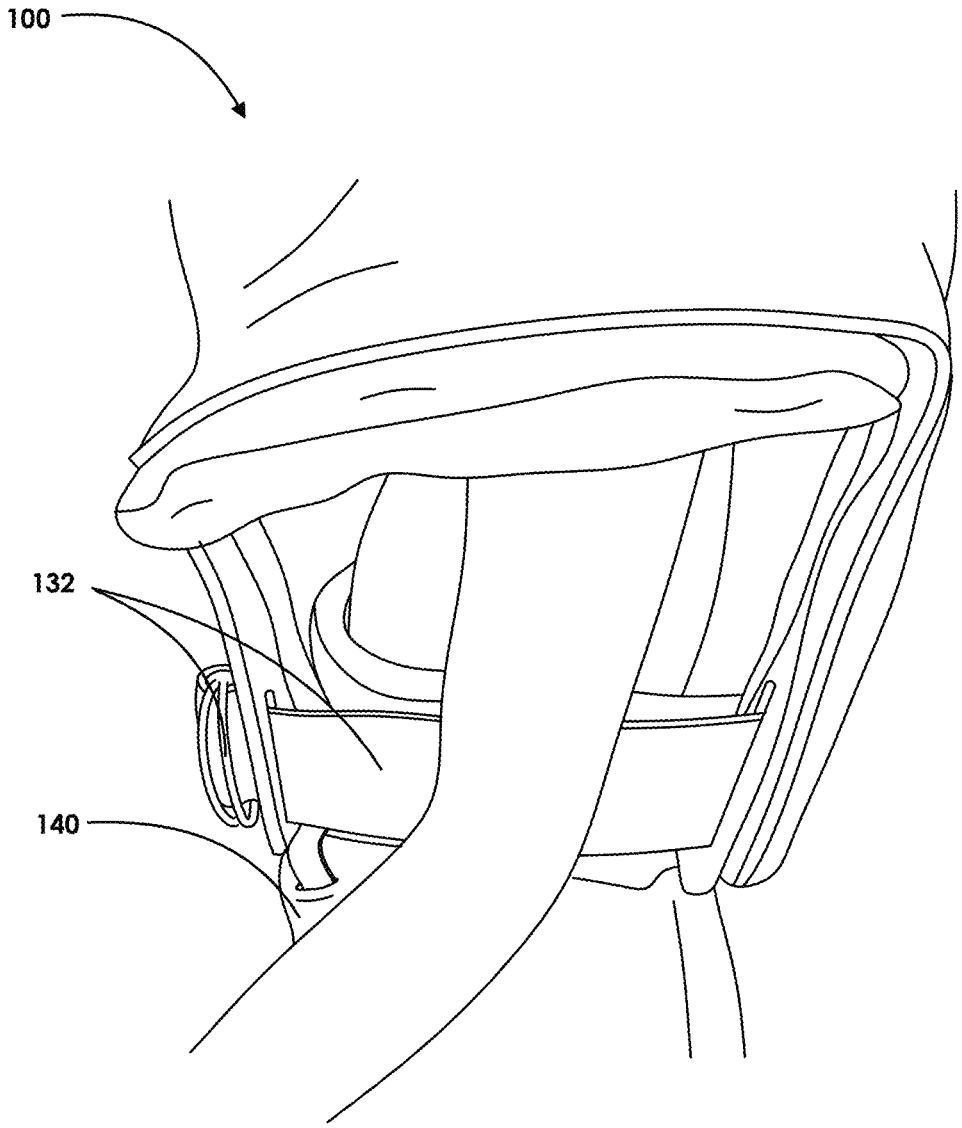
FIG. 5 illustrates a partial right side view of the impact protection suit of FIG. 1.
Figure 6:
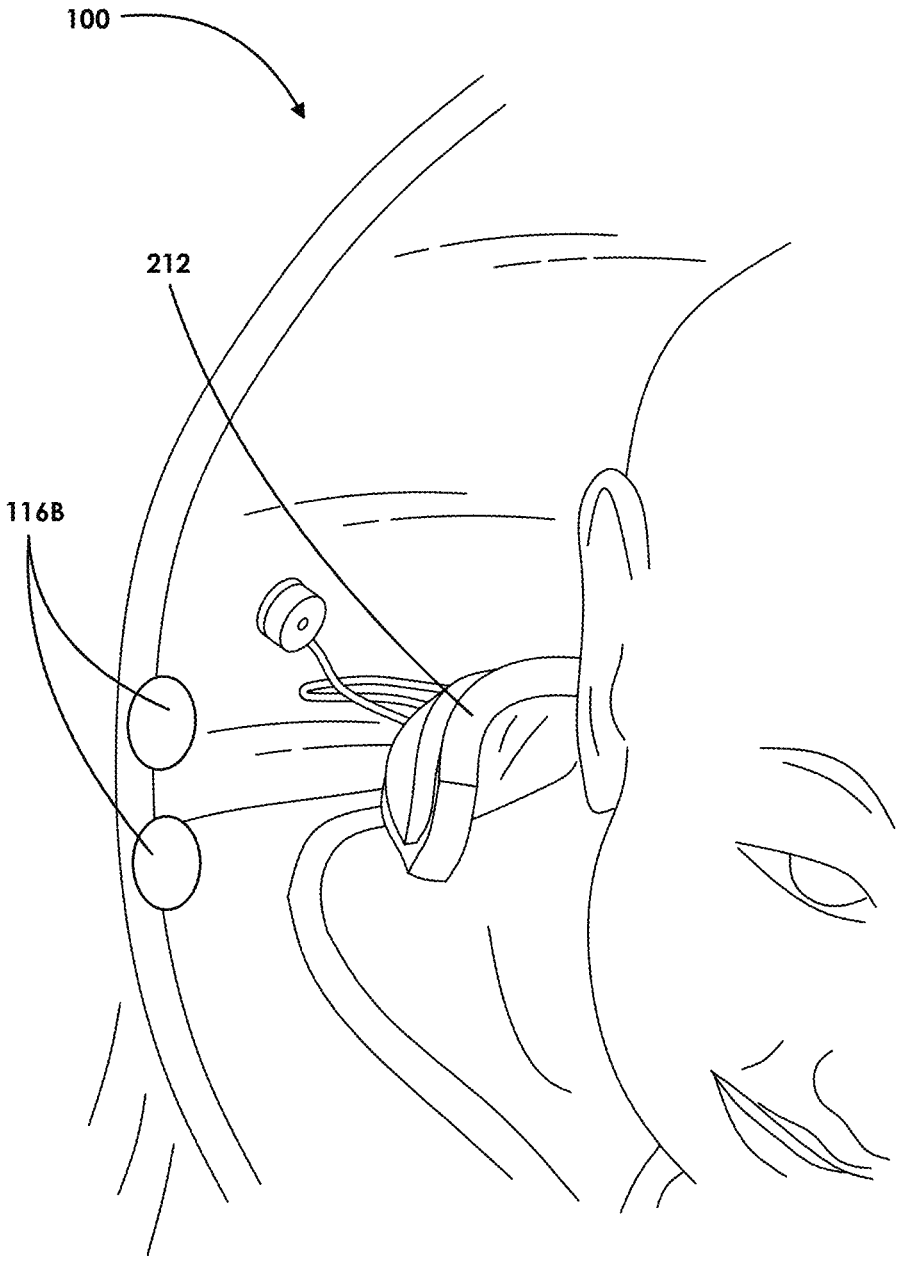
FIG. 6 illustrates a close-up interior view of the impact protection suit of FIG. 1.

FIG. 5 illustrate left or right side views of suit 100. In particular, suit 100 is shown with straps 132 that may wrap around the back torso region of the suit and then be tightened and secured to the front torso region of the suit, thereby providing a snug and secure fit to the user. Moreover, since the straps run under the user's arms and may be padded or shielded for rib protection, it can further help prevent the suit from coming off of the user during play or impact. Here, the straps are shown being secured to D-loops or buckles, however, it is contemplated within the scope of the disclosure that any type of securement or fastening means may be used, such as carabiners, buckles, or hook and loop fasteners. Referring back to FIG. 1, straps 132 that can also be secured and looped within and around an eyelet, groove, or slit within the user's pants 140, to help further prevent suit 100 from being dislodged or removed from the user's body. Here, pants 140 may be custom configured to include the eyelets, grooves, or slits on the waist band region of the pants such that they align with straps 132 of suit 100.

Figure 7A:
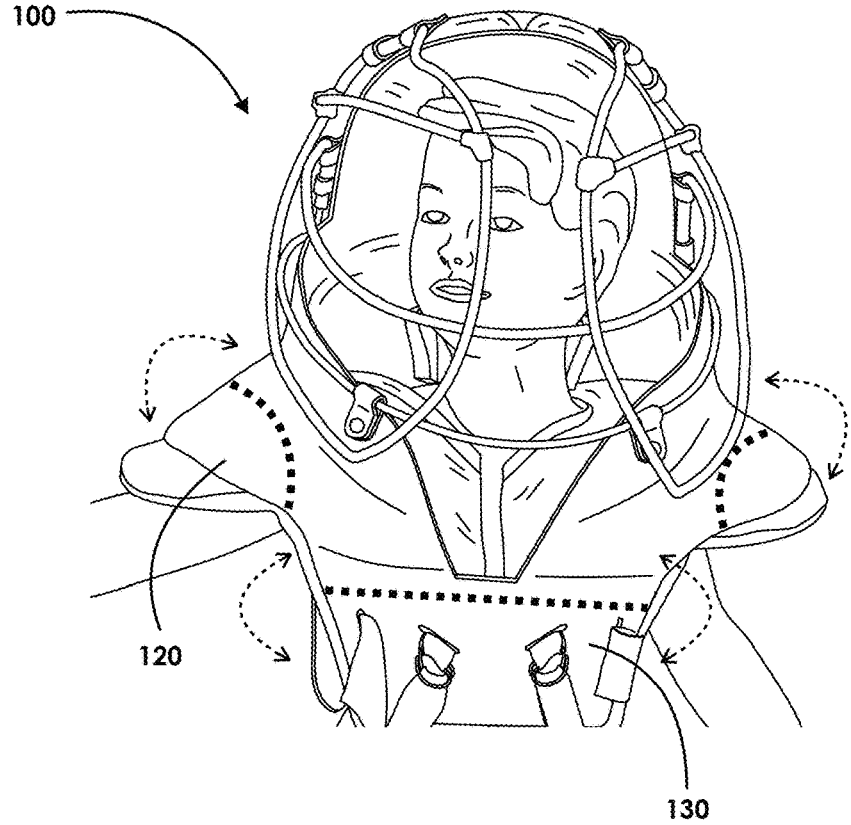
FIG. 7A illustrates a partial front view of the impact protection suit of FIG. 1 illustrating articulating shoulder guard regions and an articulating front torso guard region.
Figure 7B:
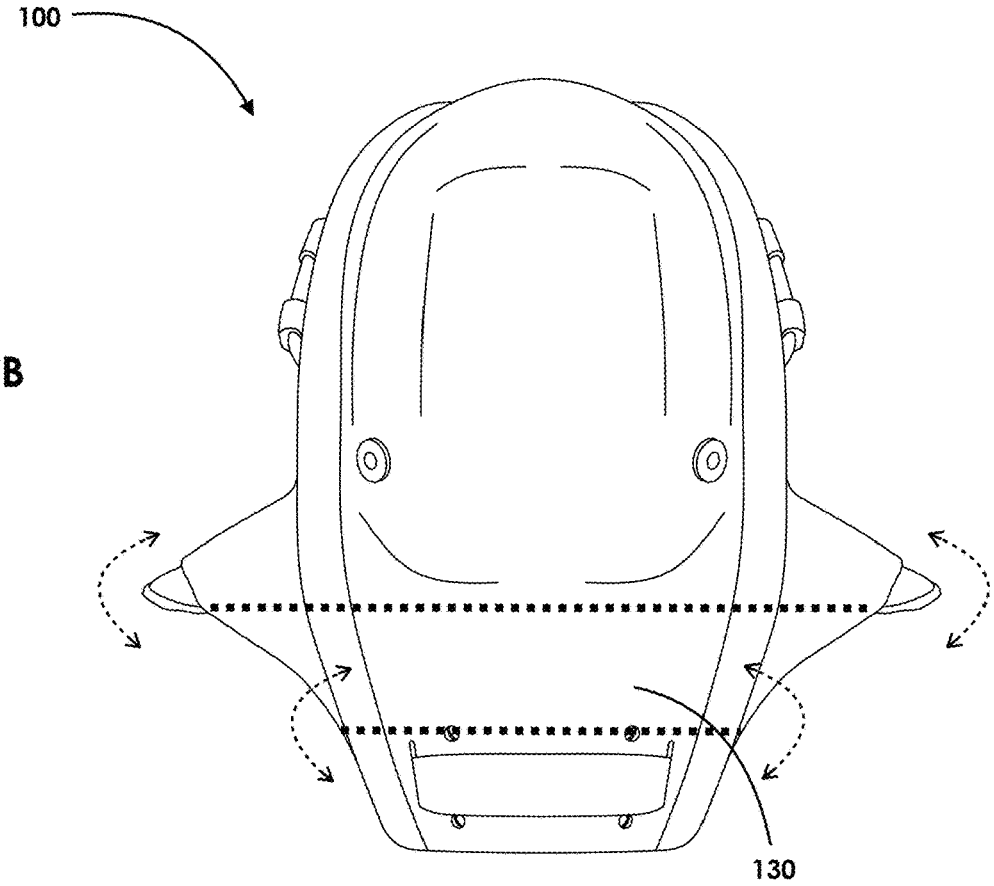
FIG. 7B illustrates a partial rear view of the impact protection suit of FIG. 1 illustrating articulating regions for the rear lower torso guard.

FIGS. 7A-7B further illustrate articulating regions of suit 100. More specifically, the suit 100 may include articulating, hinged, or pivoting shoulder and torso regions. Here, each shoulder region of the outer shell (and interior pads) may have a pivoting axis point (as illustrated by the broken lines) or hinge, that can allow the shoulder areas to articulate upon impact, such as body-to-body or body-to-ground, which further help in preventing injury to an opposing player and/or the user. In addition, front and back torso regions 130 of suit 100 may also include multiple pivot points or pivot regions to provide more flexibility for suit 100, such that the suit can better move with natural movement and alignment of the user's neck, spine, and back regions, to further help prevent injuries.

FIGS. 8-17B illustrates another non-limiting exemplary embodiment of the impact protection suit of the disclosure described herein. Here, the upper (helmet) portion of suit 300 includes an interior region that is spacious enough to allow the wearer to freely move their head in all directions without the head making contact with inside of the suit compartment, even after an impact with the ground or another player. More specifically, the spacious upper compartment does not transfer energy and forced impact to the head, skull, brain, and, neck among others, because of an air gap and spacing 340 within the head region of the suit that separates the head and neck from the interior walls of the compartment itself. As shown in FIGS. 8-10, the top head region continuously extends to the rear and front regions (torso region) of suit 300, thereby forming one integrated seamless unibody or seamless single unitary design. In particular, as the upper head region (both front and back) merge with the lower shoulder and torso region, they merge in a continuous unitary orientation with no seams or breaks connecting the upper and lower regions of suit 300. Unlike prior art helmets and suits, the integrated unibody design of the helmet and torso of suit 300 effectively eliminates the possibility of the helmet region of suit 300 from being detached from the torso region of the suit during impact with another player or the ground. In particular, the integral unibody design of the upper and lower portion of suit 300 allows the energy from impacts to transfer, dissipate, and be absorbed throughout the entire suit, thereby further minimizing the impact force on the user.

Figure 11:
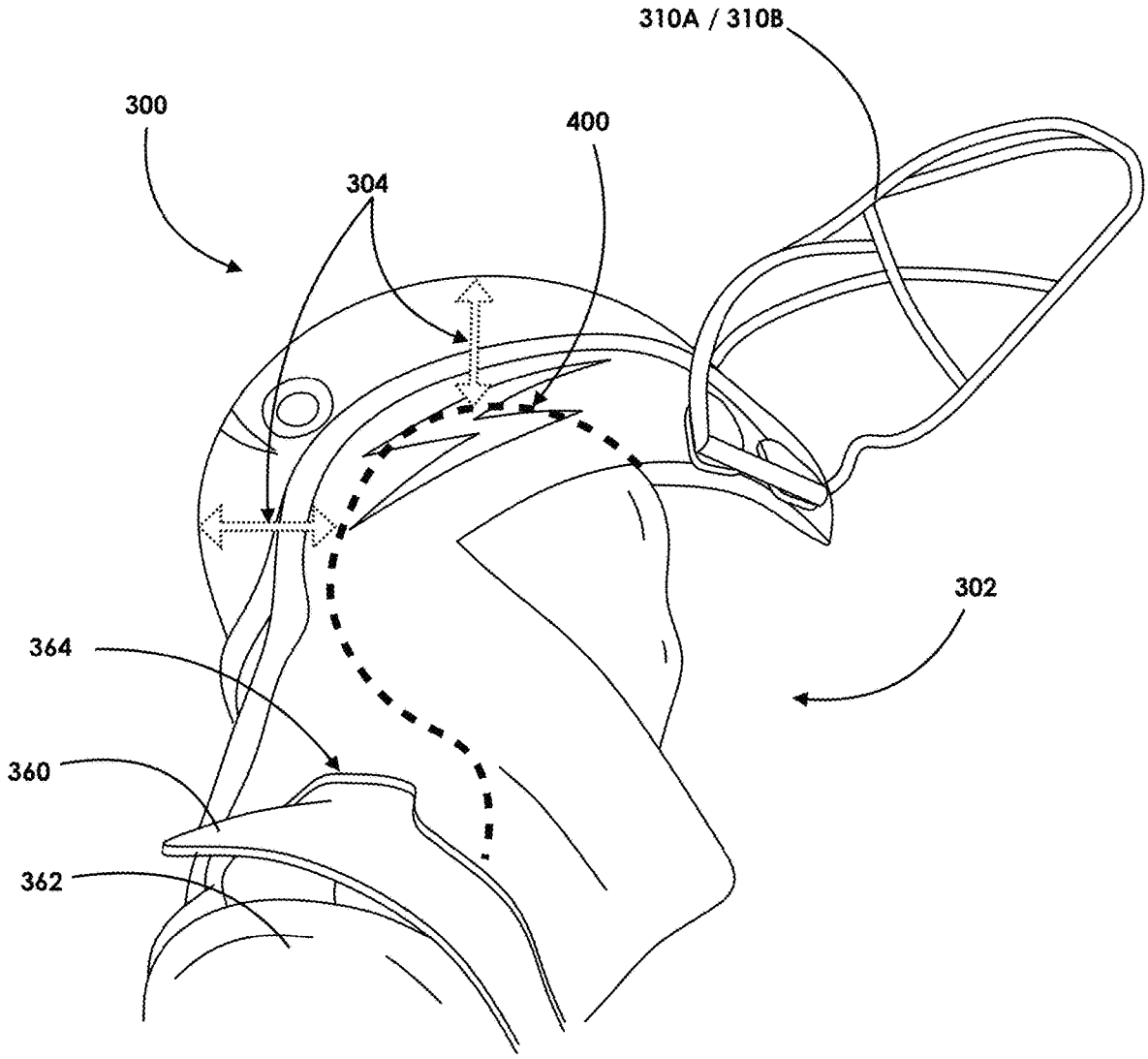
FIG. 11 illustrates a partial side view of the impact protection suit of FIG. 8.

FIG. 11 further illustrates suit 300 shown having ample spacing or gap 304 between the top and rear of user's head and neck region and the interior walls of the head region of the suit 300. Specifically, suit 300 is optimized to allow for certain movement (or minimized movement) of the user 400's head at the moment of impact within the interior region of the head region of the suit but without coming into direct contact with the interior top, side, back walls and front mask/guards 310A and 310B of the head region of the suit. More specifically, the air spacing or gaps 304 allow the user's head to naturally move if needed but prevents the head from coming into direct contact with the interior walls of the head region of the suit at the moment of impact, unlike conventional football helmets, which help to prevent, minimized, or eliminate head, brain, neck, or spinal injuries, wherein the air gap spacing prevents vertical and horizontal contact of the user's head with the interior surface of the housing. Here, spacing 304 may be anywhere from about one-inch up to six-inches or more, preferably at least about one-inch.

In addition, suit 300 is shown with a pair of bilateral symmetrical independently articulating face guards or cages 310A and 310B that can articulate upwards and away from the user's face to allow unobstructed access or opening to the user's head. In particular, each face guard 310A and 310B can articulate about a pair of fixed pivot point clamp members 312. Here, fixed points 312 each comprise closed looped clamp members that at least partially wrap around and enclose a top bar region of guards 310A and 310B. Clamp members 312 are further fixed to the upper (helmet) head region of suit 300 via bolts or screws. It is further notable that guards 310A and 310B further extend down to the base or shoulder region 300A of suit 300 (FIG. 8) and make contact and abut region 300A of suit 300. This contact with region 300A allows impact energy and force from the upper (helmet) portion to be transferred and further absorbed by the lower (torso) portion of suit 300, further minimizing the force of the impact. In addition, this large extended configuration of guards 310A and 310B allows for a large unobstructed opening of the upper (helmet) portion 302. In particular, once guards 310A and 310B are in their open position (FIG. 9), then there is greater access to the entire user's 400 face, head, and neck within the upper portion of suit 300. In particular, if user 400 needs to eat or drink any fluids then he/she can easily be able to via the large opening 302 of suit 300. In addition, this allows for better access to the user's head, face, and neck region in case of a medical emergency. In addition, the symmetrical cross-configuration of the grill bars of each guard 310A and 310B allow for superior line-of-sight vision from within the suit while maintaining structural rigidity of the upper portion. In particular, the cross-configuration of the bars of each guard 310A and 310B, once secured to suit 300 via the securement and latch members, acts to prevent the top head region from collapsing upon impact.

Figure 14:
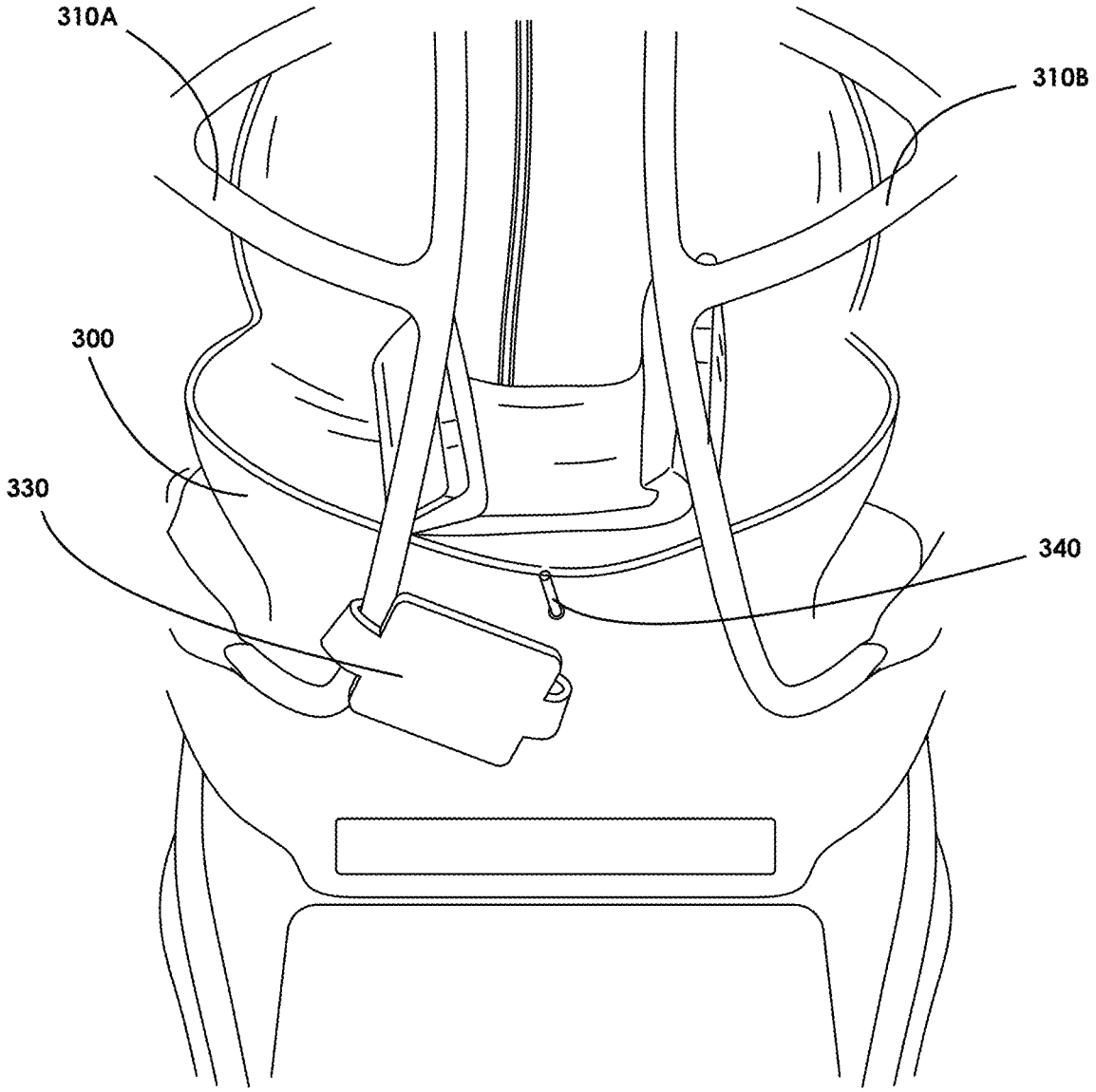
FIG. 14 illustrates partial front view of the impact protection suit of FIG. 8, further illustrating a face guard securement member.
Figure 15A:
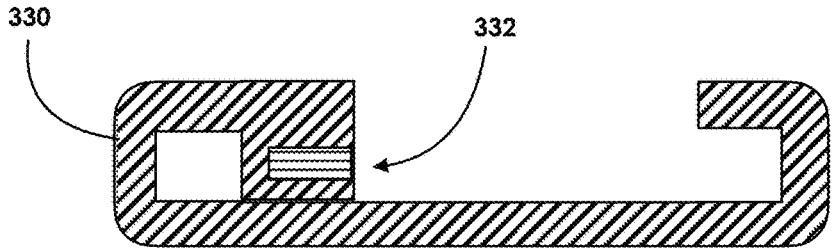
FIG. 15A illustrates a partial simplified top view of the securement member of FIG. 14.
Figure 15B:
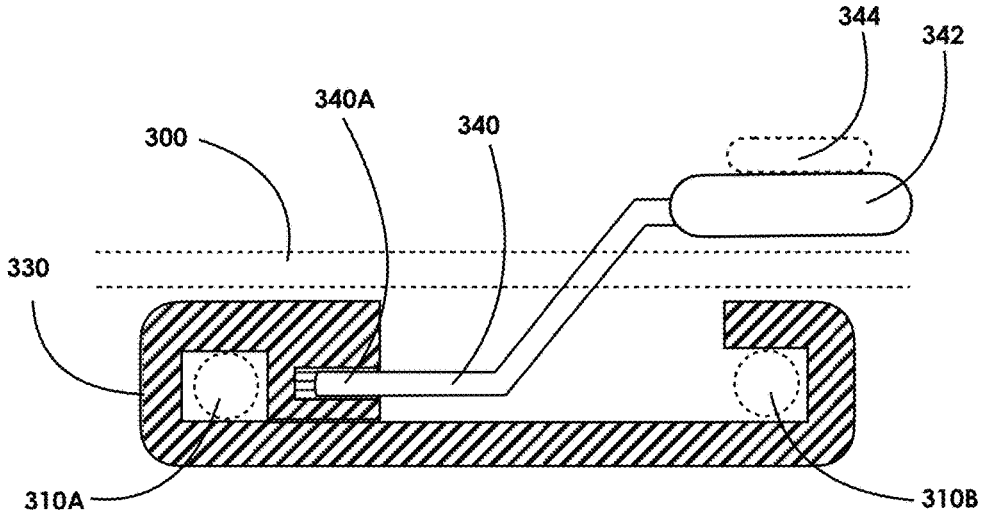
FIG. 15B illustrates another partial simplified top view of the securement member of FIG. 14, further illustrating a latch.
Figure 15C:
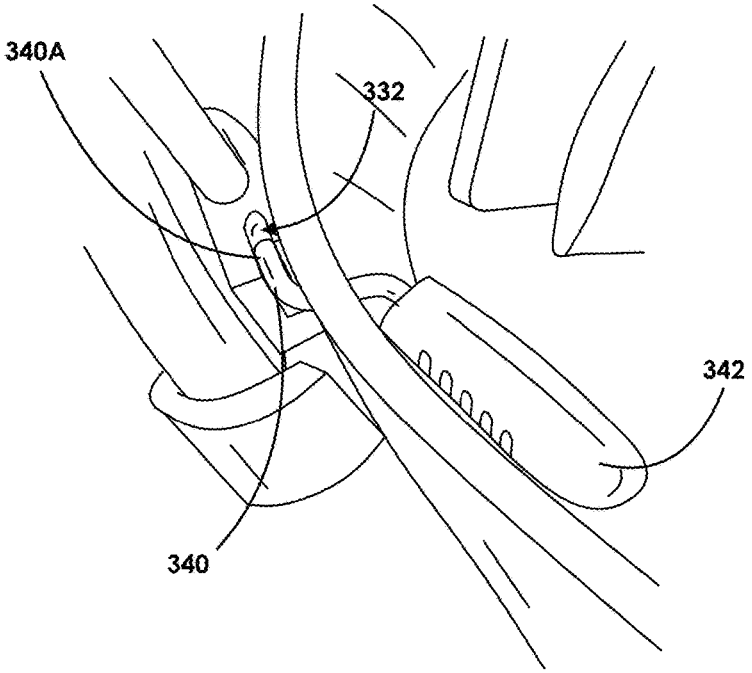
FIG. 15C illustrates a partial top perspective view of the interior of the impact protection suit and securement member and latch of FIG. 14.
Figure 16A:
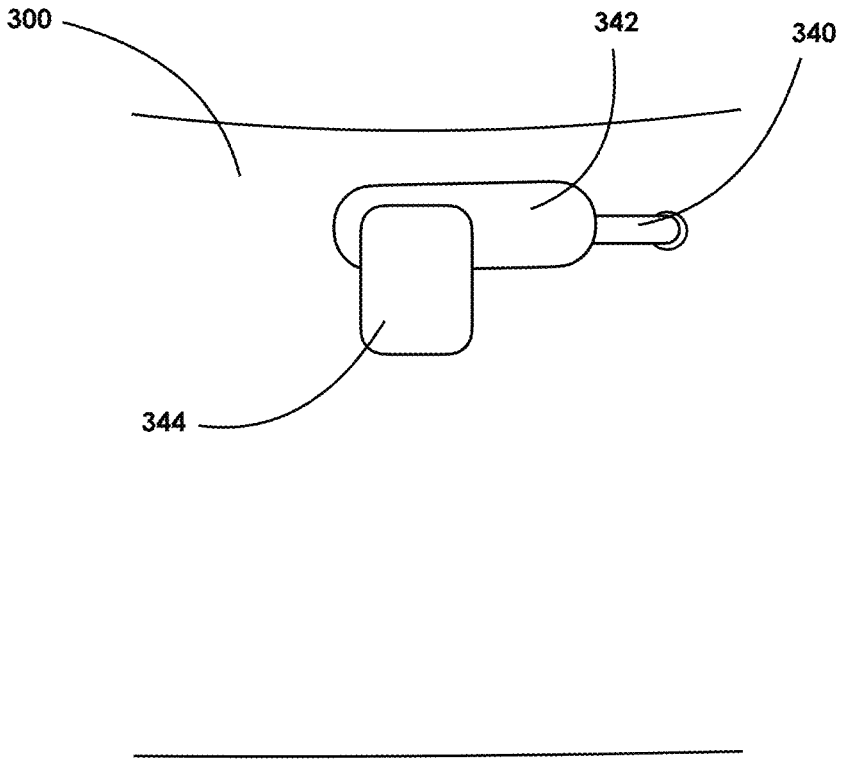
FIG. 16A illustrates a partial simplified interior rear view of a tab and the latch for the impact protection suit of FIG. 8.
Figure 16B:
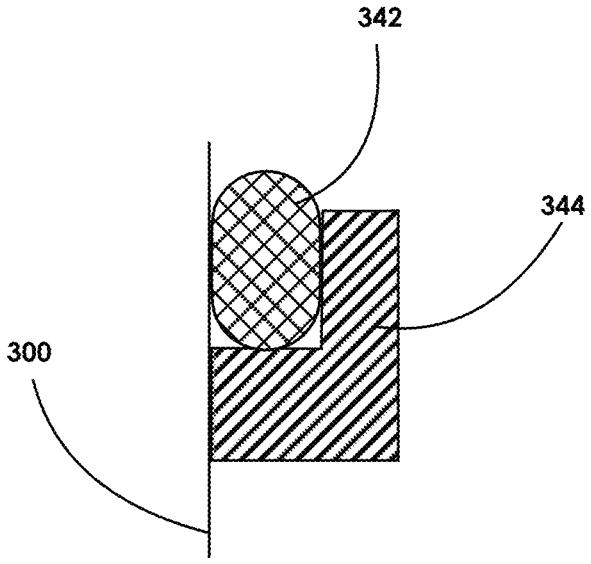
FIG. 16B illustrates a partial simplified cross-sectional left side view of the tab and latch of FIG. 16A.

Referring to FIGS. 14-16, suit 300 also includes the removable securement member 330 and latch 340 that can secure, fasten, and effectively lock each face guard 310A and 310B together. In particular, each end of member 330 includes a J-hook type of opening configuration, wherein the ends at least partially enclose and securely hold a bar or member of each respective face guard 310A and 310B. Here, member 330 is comprised of a flexible material that can allow a member of guards 310A and 310B to "snap" or snap-fit via friction fit within the openings of each J-hook end of member 330. In addition, one J-hook end of member 330 may also completely wrap and enclose a member of guard 310A and further include a latch receiving region 332. In particular, region 332 can be a channel, groove, or cut-away within the body of member 330, that allows it to receive and engage a distal end pin member 340A of latch member 340, thereby effectively locking and latching member 330 to the upper body portion of suit 300. Here, latch member 340 can articulate and pivot via a pivot point (or opening) within the body of suit 300, such that the distal pin extends out and is controlled via a lever/handle 342 from within the interior body of suit 300. In addition, a projection or tab 344 having an opening therein can further receive and secure lever 342 of latch 340 therein to prevent latch 340 from inadvertently disengaging region 332 of member 330. In particular, as shown in FIG. 16A, handle 342 can abut against the walls of tab 344 and further against the interior wall of suit 300. Accordingly, an upward force against the pin of latch 340 would prevent the pin 340A of latch 340 from disengaging opening 332 of member 330, since tab 344 operates as a stop member countering the upward force on latch pin 340. Here, the combination of securement member 330, latch 340, and tab 344 effectively prevent and eliminate member 330 from being detached from guards 310A, 310B, and suit 300 from impact.

Figure 13A:
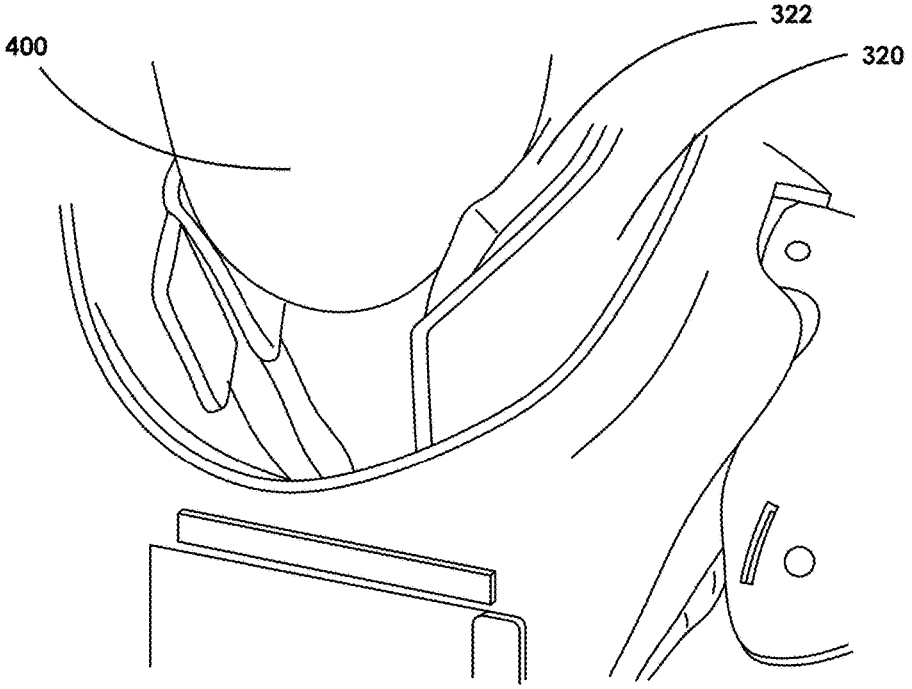
FIG. 13A illustrates partial interior perspective view of the impact protection suit of FIG. 8 illustrating face, head, and jaw support and padding regions.
Figure 13B:
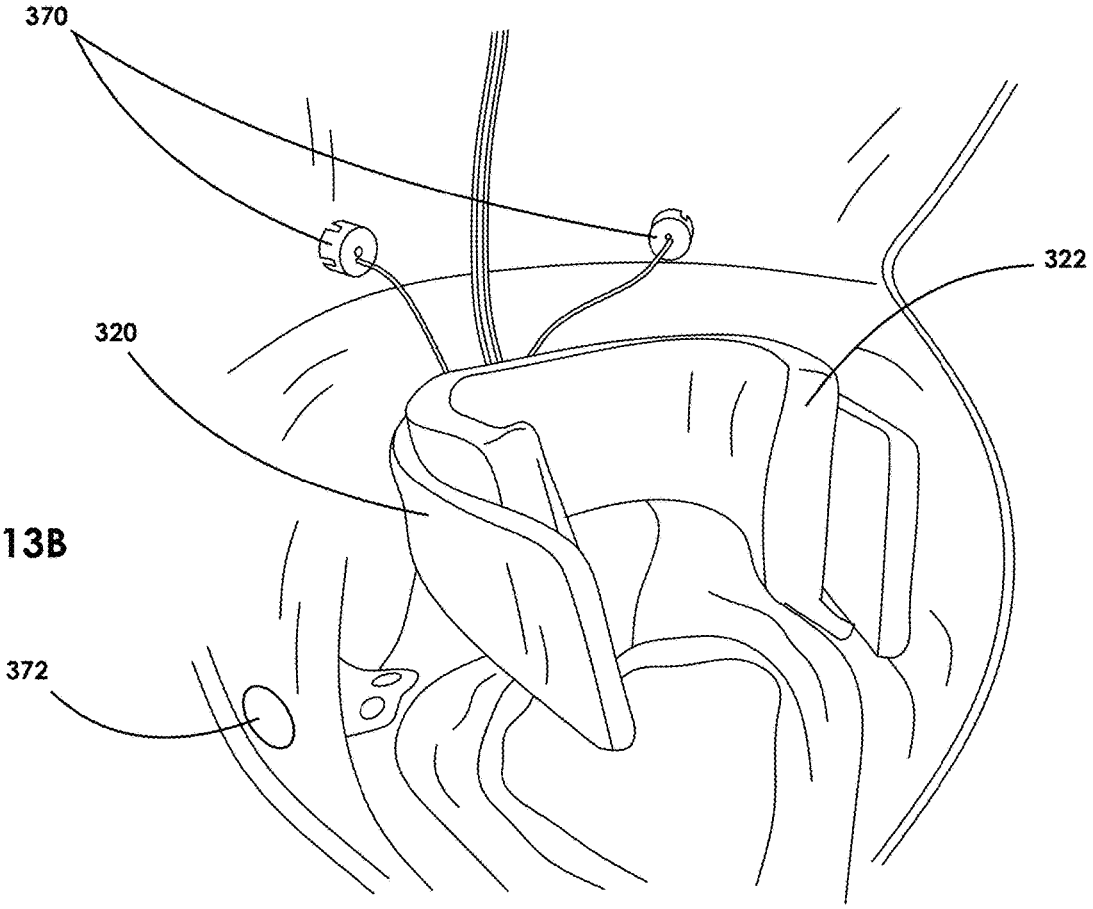
FIG. 13B illustrates another partial interior perspective view of the impact protection suit of FIG. 13A.

Referring to FIGS. 13A-13B, the interior region of suit 300 also includes recoiling and adjustable support member 320 and padding member 322 for the head, jaw, and neck of the user. In particular, an outer flexible plastic support cover 320 is secured to the interior region of suit 300 and away from its walls in an arched configuration that can partially wrap around a user's neck. Further, cover 320 can also support inner padding 322 secured thereto to provide further cushioning and comfort to the user 400's neck. Here, members 320 and 322 are configured to articulate and recoil upon impact and further supports the user's head, jaw, and neck in a natural orientation. In addition, members 320 and 322 can also operate as a neck brace or neck collar to help further prevent the user's head and neck from excessive sudden movement upon impact, such as whiplash, thereby keeping the user's neck and spine in a more natural alignment.

Further, the area around padding 322, between the padding 322 and member 320, or on the exterior of padding 322 allow for the storage, placement, securement, or mounting of a mobile computing device, such as a cellphone, camera, or other object (not shown). Alternatively, the interior space of the head region further allows for the placement, securement, or mounting of a mobile computing device such as a cellphone, camera, or other device or object (not shown).

Figure 12:
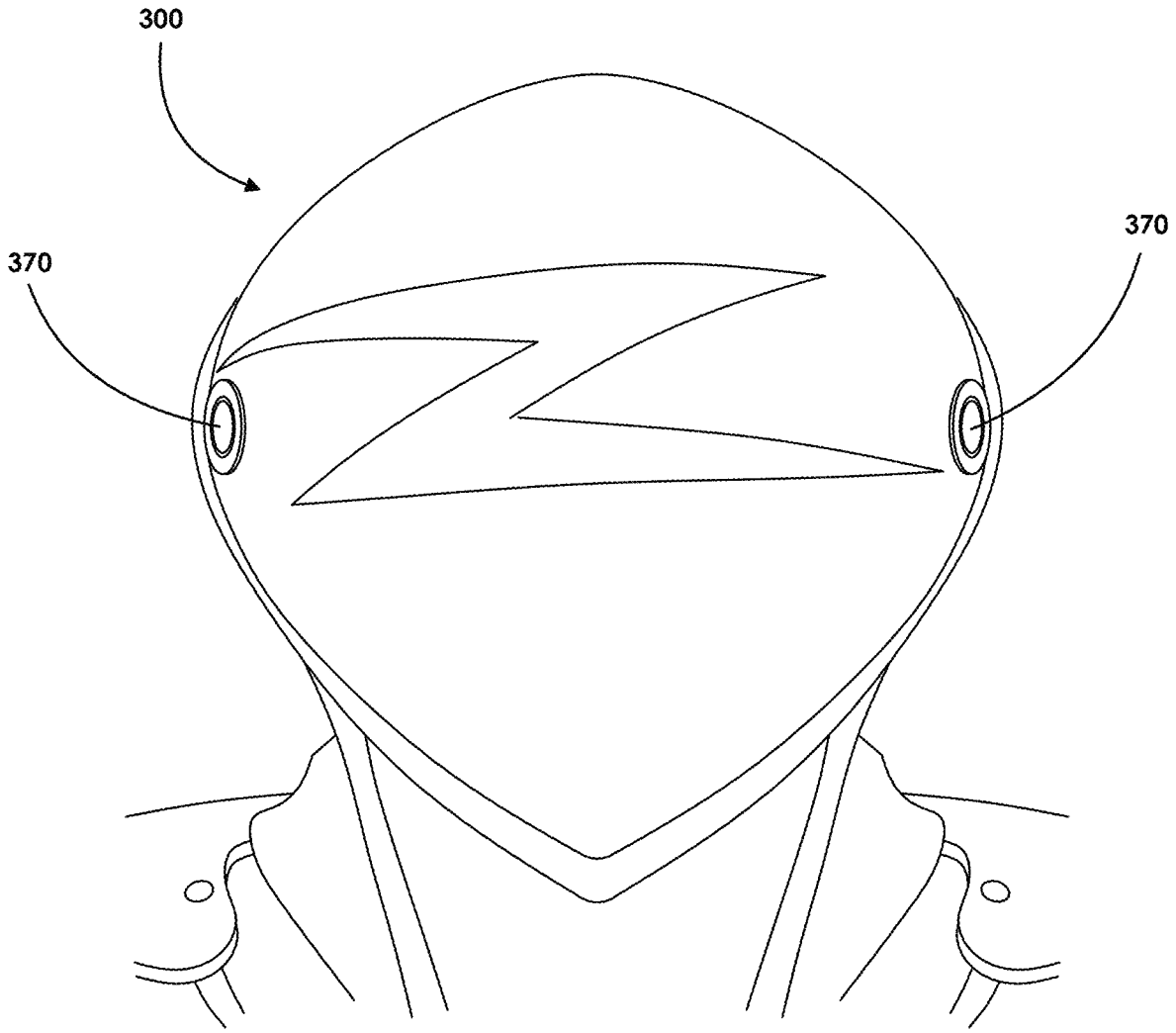
FIG. 12 illustrates a partial rear view of the impact protection suit of FIG. 8.

Referring to FIGS. 12 and 13B, suit 300 may include a pair of proximity detectors, cameras, or sensors 370 that extend to the exterior shell of the upper (helmet) portion of suit 300. In particular, sensors 370 can detect nearby surroundings such as on-coming or potential impact from an opposing player, and also have video and audio recording capabilities. In addition to or in lieu of sensors 370, suit 300 can be configured to be integrated with an existing mobile device with an application or software having such camera and recording capabilities. In particular, sensors 370 may also communicate with a computing device or network system that can communicate with and signal to one or more visual and audio signal interfaces 372 within suit 300 adjacent to the user's head. For example, interface 372 may be a digital display and audio output device configured as an alert or notification system, that can alert the user that one or more opposing players are behind, near, around, or in proximity to the user and may pose a potential impact. For example, sensors 370 may be programmed with certain software to sense one or more opposing players (or objects or human bodies) up to a 25-foot radius. In addition, a user may custom configure the range of the sensors, such as only alerting the user when an opposing player is within 10 feet of the user, among other configurations. In addition, each team can have their own set of suits 300, wherein one team has a certain chip or RFID component integrated into the head region of the suit that can only be detected by the opposing team, and not the user's same team (i.e. to help prevent false alarms of the user's same teammates within the user's proximity who may not cause an intentional impact/hit/tackle).

In addition, the user may also custom configure the azimuth, arc, or square foot coverage of the proximity to be detected via sensors 370, such as a 45-degree area behind the user or 360-degrees around the user. In addition, sensors 370 may also provide tracking abilities of the user's movement and logging such data, or keeping count of the number and/or severity of impacts/hits that the user received during a game. For example, the sensors 370 may also include gyro-meters or accelerometers, or any other environmental/stress/velocity/acceleration detection component, that can assist to ascertain the number and/or severity of impact. Here, such data may be automatically uploaded from suit 300 via a network to a central server or downloaded to a user's mobile device to be viewed within an application on the user's mobile computing device. In another embodiment, display or audio output devices 372 can allow the user or player to see a red flashing light above their right if the pressure or impact is coming from the player's rear right side. Alternatively, when the when the pressure or impact is coming from the user or player's rear left side, the player will see a blue flashing light above their left eye. Here, it is contemplated within the scope of the present disclosure described herein that multiple alert devices 372 can be configured anywhere near or adjacent to the user's head in any configuration or orientation depending on the application.

As shown in FIGS. 8-10, the lower (torso) portion of suit 300 can further protect the shoulders/upper torso of the user, which is also padded. In particular, suit 300 may also include shoulder guards 360 and articulating shoulder extension pads 362 on each side of suit 300 as shown with respect FIG. 10. Here, shoulder pads 362 can be comprised of padding having an outer hard shell that can pivot and articulate about an axis, while covering the shoulder and upper arms of user 400. Extended shoulder guards 360 can be extensions from the main suit 300 that protrude outwards from suit 300 to cover the shoulder region of user 400, wherein the shoulder guards 360 are fixedly secured to suit 300 and may be rigid or partially flexible upon impact (or further articulate and pivot relative to suit 300). It is contemplated within the scope of the present disclosure described herein that shoulder guards 360 and pads 362 can be integrated with suit 300, or in the alternative, guards 360 and pads 362 can be worn as an independent third-party football shoulder vest in which suit 300 can accommodate. Specifically, as shown in FIG. 11, suit 300 may include a cut-away or notch 364 that can allow each of shoulder guards 360 to be partially received and fitted within the upper torso region of suit 300, such that guards 360 (worn as a separate vest) may be allowed to freely pivot and articulate as needed independent of suit 300.

Figure 17A:
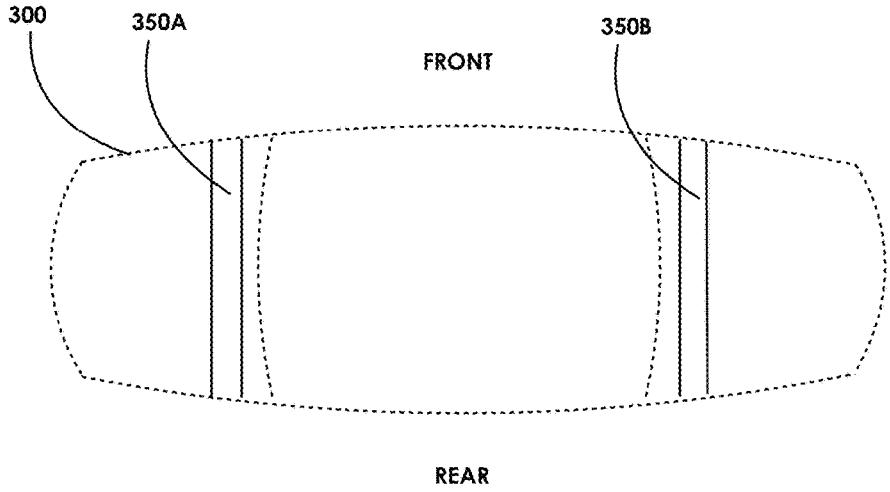
FIGS. 17A-17B illustrate partial simplified interior top views of the impact protection suit of FIG. 8, further illustrating a pair of armpit support bars.
Figure 17B:
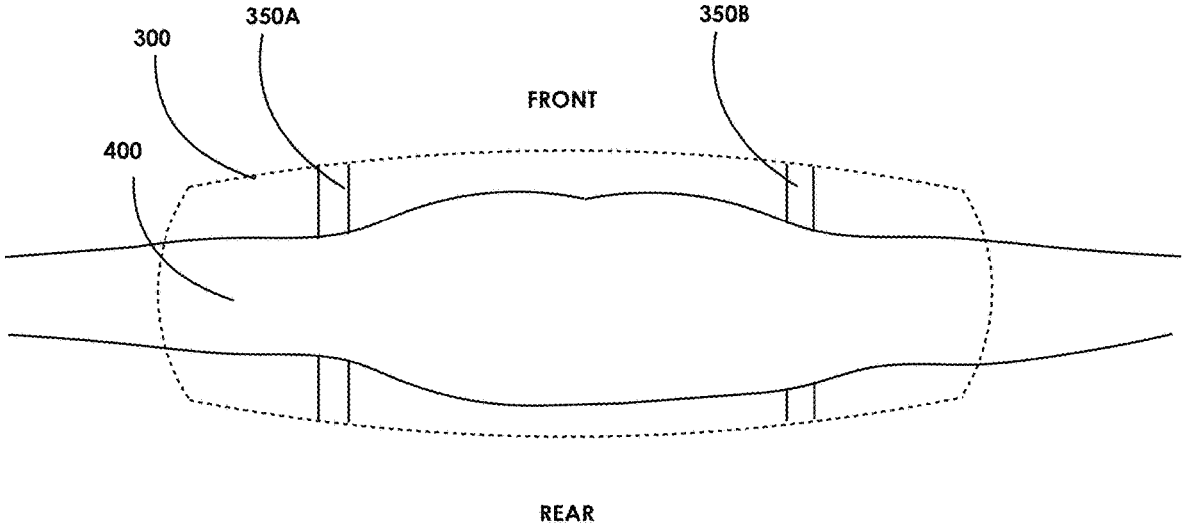

Referring to FIGS. 17A-17B, suit 300 can also include armpit support bars 350A and 350B fixed to the interior torso region of suit 300 near the shoulder/chest area. In particular, the support bars 300 can be rigid or flexible in structure that allow the user 400 to place each respective arm over bars 350A and 350B, such that bars 350A and 350B are positioned under the armpit region of user 400. Here, bars 350A and 350B effectively prevent and eliminate suit 300 from detaching from the user's body upon forceful impact, thereby securely keeping the suit on the user's body at all times. Here, bars 350A and 350B may also be padded for comfort. The suit can be later removed from the user's body by the user raising his/her arms above his/her head thereby allowing bars 350A and 350B to be slid out and the suit released from the user's body.

Further, suit 300 is shown having a compartment 380 within the front region having a sliding lid or cover 382 that can allow the user to store any objects therein, such as a mobile device or cellphone. Here, it is contemplated within the scope of the disclosure described herein that any of the aforementioned components with respect to components suit 100, such as features and components 112A, 112B, 112C, 110, 116B, 120, 130, 132, 140, 210, and 212, including its articulating regions, are also applicable with respect to the embodiment of suit 300.

Here, it is contemplated within the scope of the disclosure described herein that the suit 100 or 300 apparatus may be generally configured to be used on children, such as from the ages of four (4) up to 18 years old who play American style football. However, the suit may also be used for adults who are 18 years old and up in addition to amateur or professional football players, among other users. Moreover, each suit 100 or 300 may also be custom molded, sized, and configured depending on the height, size, and weight of the individual wearing it. In addition, each suit 100 or 300 may also allow optional accessories to be attached thereto, such as rear, side view, or convex mirrors secured to the face/guard region to allow the user to better see his or her surroundings, or various types of lighting or night vision. In addition, the suit 100 or 300 can allow attachment points for microphones, cameras, mobile devices, head phones, speakers, or any other audio/visual equipment for listening, speaking, or communicating wirelessly, among other advantages.

From the foregoing it will be seen that the present disclosure described herein is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts described herein, except insofar as such limitations are included in following claims. Further, it will be understood that certain features and sub-combinations are of utility and may be employed without reference to other features and sub-combinations. This is contemplated by and is within the scope of the claims.

What is claimed is:

1. An impact protection suit, comprising:

an upper head region comprised of a helmet having an interior surface, wherein the helmet is configured to at least partially extend over a user's head;

a first and second face guard coupled to the helmet, wherein each of the first and second face guards are configured to independently pivot relative to each other;

a neck guard disposed within the helmet;

a securement member configured to secure the first and second face guards to each other;

a latch configured to engage the securement member; and wherein the helmet of the head region is configured such that a vertical air gap of at least one-inch and a horizontal air gap of at least one-inch is provided between the user's head and the interior surface of the outer helmet, whereby the vertical air gap and the horizontal air gap allows the user's head to move within and relative to the outer helmet and further prevents vertical and horizontal contact of the user's head with the interior surface of the helmet.

2. The impact protection suit of claim 1, further comprising a torso region.

3. The impact protection suit of claim 2, further comprising a shoulder region, wherein the shoulder region and the torso region include one or more cushioned paddings.

4. The impact protection suit of claim 3, wherein the shoulder region further comprises a pair of bars positioned below an armpit of the user.

5. The impact protection suit of claim 1, wherein the vertical and horizontal air gap is within a range from one-inch up to six-inches.

6. The impact protection suit of claim 1, further comprising one or more audio or visual notification interfaces.

7. The impact protection suit of claim 1, further comprising articulating or pivoting shoulder and torso regions.

8. An impact protection suit, comprising:

an upper head region is configured such that a horizontal and vertical air spacing is provided between a user's head and an interior surface of the upper head region, whereby the air spacing allows the user's head to move within and relative to the upper head region and further prevents vertical and horizontal contact of the user's head with the interior surface of the upper head region;

a neck collar near the upper head region;

a lower torso region, wherein the upper head region and the lower torso region are seamlessly integrated with each other as one unitary piece;

a first guard member and a second guard member secured to the upper head region, such that the first and second guard members each independently articulate about an axis;

a securement member configured to secure the first and second guard members to each other; and a latch configured to engage the securement member.

9. The impact protection suit of claim 8, wherein the air spacing is configured to be at least one-inch.

10. The impact protection suit of claim 8, wherein the air spacing is from about one-inch up to six-inches.

11. The impact protection suit of claim 8, further comprising one or more proximity sensors.

12. The impact protection suit of claim 8, further comprising one or more audio or visual notification interfaces.

13. The impact protection suit of claim 8, further comprising a compartment within the lower torso region, wherein the compartment further comprises a sliding cover, such that the compartment is configured to store an object.

* * * * *